United States Patent [19]

Rasch

[11] 4,011,852

[45] Mar. 15, 1977

[54] CYLINDER HEAD FOR INTERNAL COMBUSTION ENGINES

[75] Inventor: Walter Rasch, Nurnberg, Germany

[73] Assignee: Maschinenfabrik Augsburg-Nurnberg AG, Nurnberg, Germany

[22] Filed: Feb. 14, 1975

[21] Appl. No.: 550,154

[30] Foreign Application Priority Data

Feb. 16, 1974 Germany ..... 2407528

[52] U.S. Cl. ..... 123/188 S; 29/156.7 A; 123/193 H

[51] Int. Cl.[2] ..... F22B 5/00

[58] Field of Search ..... 123/193 H, 188 S; 29/156.7 A, 156.7 R

[56] References Cited

UNITED STATES PATENTS

| | | | |
|---|---|---|---|
| 2,696,810 | 12/1954 | Kuepfer | 123/188 S |
| 3,868,953 | 3/1975 | Roll | 123/188 S |

*Primary Examiner*—Albert W. Davis, Jr.
*Assistant Examiner*—Craig R. Feinberg
*Attorney, Agent, or Firm*—Walter Becker

[57] ABSTRACT

A cylinder head for internal combustion engines in which at least two adjacent passages for inlet and/or outlet valves are provided with seating rings. The outer peripheral surface of each seating ring which surface faces toward the adjacent seating ring is provided with a flattened area directly engaging a corresponding flattened area of the adjacent seating ring faced thereby.

4 Claims, 4 Drawing Figures

CYLINDER HEAD FOR INTERNAL COMBUSTION ENGINES

The present invention relates to a cylinder head for internal combustion engines in which at least two adjacent openings with seating rings for inlet and outlet belts are provided.

It is known that cylinder heads of internal combustion engines are exposed to high thermal alternating stresses. If the inlet and/or outlet valves are arranged in the cylinder head, the web region between two valve openings which for reason of space alone is narrow represents the highest stressed area. In many instances it is also difficult to satisfactorily cool said web region. Due to the automatically non-uniform heating of the cylinder head, considerable pressure stresses occur in said web region because the material from which the web is made tends to expand but is prevented therefrom by the colder circumferential portion of the cylinder head. As a result thereof, an upsetting of the web region up to the plastic range occurs. At the subsequent cooling, the pressure stresses are again reduced and eventually in view of the preceding upsetting, in cold condition are replaced by pull tensions likewise located in the flow range. After a more or less great number of such alternating tensions, tears from at the surface, and during the further operation the tears increase through the entire material whereby the cylinder head not only becomes useless but the entire driving mechanism may, for instance with water-cooled engines, be destroyed by the entry of water.

Furthermore, the described heat tensions are superimposed by tensions which occur due to the varying load range of the engine. Finally, the web region is additionally subjected to tensions when, as customary, an outlet valve is arranged adjacent an inlet valve because the outlet passage is exposed to considerably higher temperatures than the inlet passage.

In order to prevent tear formation in the webs between the two valves, it has been the practice within this region to provide the cylinder head bottom at the side of the internal combustion chamber with narrow tension gaps which are approximately as deep as half the thickness of the cylinder head bottom. While in this way the tensions at the surface were compensated for, these tension gaps filled within a short time with hard combustion residues and became ineffective. Furthermore, it was still not possible at the base of the expansion gaps completely to prevent the formation of tears.

It has also become known to fill the described tension gaps with a sheet metal frame which is cast into the cylinder head without metallic connection. In this way, the gaps were prevented from being clogged up but the formation of tears at the base of said gaps could likewise not be prevented. It was likewise not possible to obviate this danger by flanging the sheets or the frame at a relatively short radius at the bottom of the tension gap.

In connection with a further development of the thus mentioned arrangement it has become known to merge the tension gap at its base with an arc which is slightly concavely curved and is symmetrical to a plane which is located at the cylinder side and extends at a right angle to the cylinder axis. The tension gaps thus bend uniformly into the planes of action of the tensions and extend in this general direction without stepwise changing the direction over a considerable distance. The T or angle tension gap which is likewise covered with sheets having brought about an improvement but were unable to fully prevent tensions in the interior of the web. Furthermore, it has been found that the above suggestion encountered difficulties when it was tried to be introduced in practice, and this design is therefore rather expensive compared to the obtained result.

It is, therefore, an object of the present invention with a cylinder head of the above mentioned general type to prevent the occurring of tears in the web, and to do so by simple and inexpensive means.

These and other objects and advantages of the invention will appear more clearly from the following specification in connection with the accompanying drawings, in which.

The cylinder head for internal combustion engines in which at least two adjacent openings are provided with seating rings for inlet and/or outlet valves is according to the present invention characterized primarily in that the outer surface of each seating ring which surface faces toward the adjacent seating ring is provided with a tangential flattened section, and that the seating rings directly engage each other along said flattened sections. When more than two adjacent openings provided with seating rings are arranged in a cylinder head, the outer surfaces of said seating rings are each provided with two flattened sections while the seating rings provided with two flattened sections respectfully engage a flattened section of two adjacent seating rings. The flattened sections, in order to obtain equal sizes extend advantageously perpendicularly with regard to the axis interconnecting the centers of the two openings and extend over the entire height of the seating rings. Due to the last mentioned feature, not only the recesses for the seating rings and the manufacture thereof is greatly simplified, but above all the mentioned endangered web is set back to such an extent that it can be cooled sufficiently and is located completely outside the tension zone. According to a further development of the invention, it is suggested to select the ratio of the length of the tangential flattened section with regard to the medium diameter of the respective adjacent seating rings at a ratio of approximately 1:5.

It is furthermore suggested to provide the inner diameter of the seating rings centrally as customary or eccentrically with regard to the outer diameter in view of the last mentioned feature. It is possible at a somewhat greater distance between two valve openings to save material for the seating ring while the latter itself is kept more elastic relative to the heat expansion.

Figure 1:
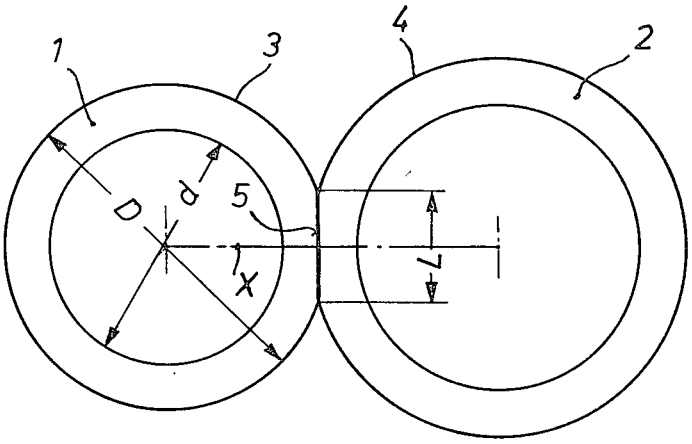
FIG. 1 shows the arrangement of two seating rings in conformity with the invention.

Referring now to the drawings in detail, FIG. 1 shows a seating ring 1 for an outlet valve and also shows a seating ring 2 for an inlet valve, the end faces of each of said rings lying in parallel planes. The outer peripheral surfaces 3 and 4 of said seating rings extend between and connect said end faces and are at those sides thereof which face each other provided with a flattened section 5. The two seating rings 1 and 2 are formed with the major portions of their peripheries cylindrical with the flattened portions as chords of the cylinders and engage each other along said flattened sections 5. The length L of the flattened sections 5, which merely for the sake of clarity are in all figures illustrated in somewhat exaggerated manner, is expediently selected in such a way that it has a ratio to the medium diameter of the interengaging seating rings which is approximately 1:5. With customary seating rings having a diameter of approximately from 50 to 60 mm, the length L may be approximately 10 mm. The flattened sections 5 extend perpendicularly with regard to the axis *x* which interconnects the center points of the valve seats whereby their lengths are approximately equal.

Figure 2:
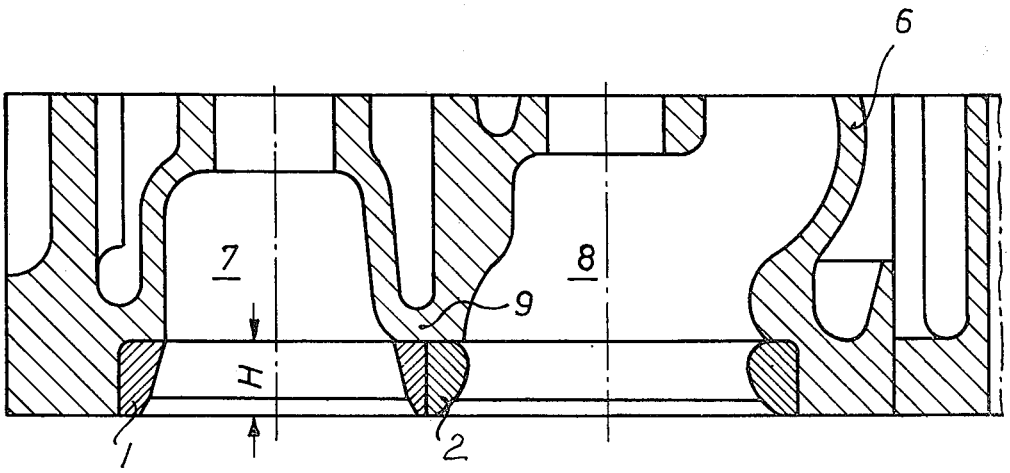
FIG. 2 represents a longitudinal section through the portion of a cylinder head with the arrangement of the seating rings according to FIG. 1.

FIG. 2 shows a portion of a water cooled cylinder head 6 in which the seating rings 1–2 are pressed by under-cooling. The height H of the seating rings 1,2 which depends, of course above all from the design of the valves is in each instance selected so great that the web 9 which remains between the two openings 7,8 representing in this instance the outlet and inlet passages respectfully is located outside the tension zone and can be well cooled.

Figure 3:
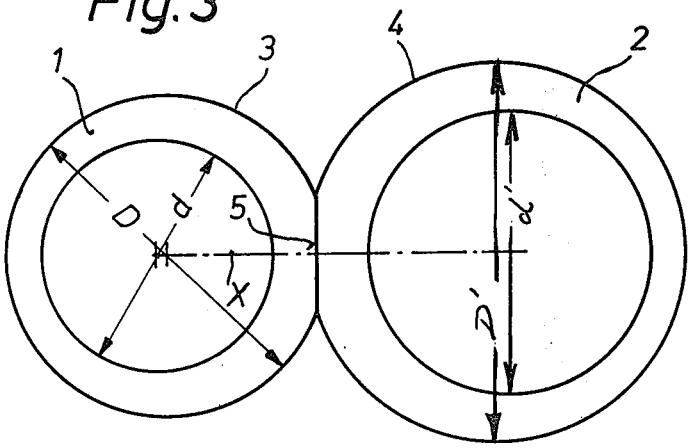
FIG. 3 shows the arrangement of two seating rings according to FIG. 1 but with an eccentric inner diameter.
Figure 4:
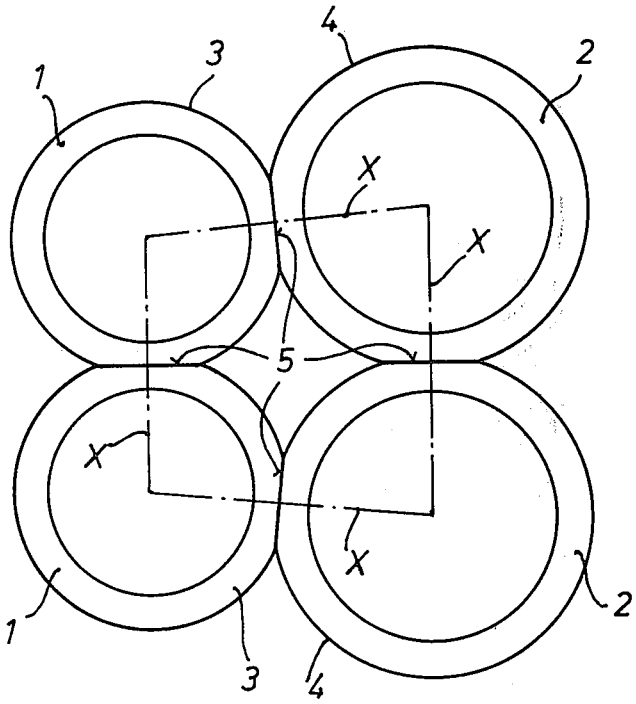
FIG. 4 shows the arrangement of four seating rings according to the invention.

FIG. 3 illustrates seating rings 1,2 with the flattened sections 5 at their outer surfaces 3,4. However, in this instance the inner diameters *d*, *d'* of the seating rings 1,2 are eccentrically arranged with regard to their outer diameters D, D' whereby the distance between the valves can be increased. Finally, FIG. 4 shows how the invention is also applicable to four valves in a cylinder head. In such an instance, the outer surfaces 3,4 of the seating rings 1,2 respectively have two flattened sections 5 along which they engage the respective adjacent seating rings.

As will be evident from the above, the present invention brings about that that portion of the cylinder head, namely the web between two valves, which is most subjected to stresses is completely eliminated so that no tensions and no tears can any longer occur in this part which tears and tensions in the course of time can bring about the destruction of the entire cylinder head. The flattened sections provide sufficient material between each two valve openings to replace the web. Since the seating rings consist of another material (alloyed gray cast iron of a high strength, a high heat resistance and hardness of approximately 400 HB) than the cylinder head (for instance a gray cast iron with a hardness of from 200 to 240 HB) and since these flattened sections relative to said cylinder head are at all areas substantially nearly uniformly heated and cooled, they will as a rule not suffer from the formation of tears. It may also be added that each seating ring is made individually and is pressed into the cylinder head so that also different temperatures as they occur for instance with inlet and outlet valves will not become effective. Finally, it should also be mentioned that the illustrated design is simple and relatively inexpensive because the cylinder head as a cast part is considerably simpler and the manufacture of the seating rings is practically no more expensive than heretofore.

It is, of course, to be understood that the present invention is, by no means, limited to the specific showing in the drawings but also comprises any modifications within the scope of the appended claims. Also with possible bores for for instance injection nozzles or spark plugs, which are provided with a seating ring and are located at only a slight distance from a valve seating ring, the present invention will be applicable.

What I claim is:

1. A cylinder head for internal combustion engines with at least two passages arranged adjacent to each other and respectively provided for valves, which includes in combination a plurality of pressed-in seating rings corresponding in number to that of said passages into which said rings are pressed and associated therewith, each of said seating rings having parallel end faces with an outer peripheral surface extending between and connecting said end faces, that outer peripheral surface being cylindrical over the major periphery of said ring and provided with an outer flattened peripheral area, each two flattened areas of two adjacent rings facing each other and directly engaging each other, each flattened outer peripheral area extending over the entire height of the pertaining seating ring between said end faces, said seating rings over the entire height thereof being press-fitted tightly into recesses of the cylinder head without providing a partial gap as seen over periphery thereof.

2. A cylinder head in combination according to claim 1, in which the ratio of the length of each flattened area to the mean diameter of the pertaining seating ring is about 1:5.

3. A cylinder head in combination according to claim 2, which includes more than two passages with a corresponding number of seating rings, and in which each of said seating rings has its outer periphery provided with two flattened areas, the arrangement being such that each two flattened peripheral areas of each of said seating rings directly engages two flattened peripheral areas respectively of two other ones of said seating rings.

4. A cylinder head in combination according to claim 2, in which the inner peripheral surface of each seating ring is eccentric to its outer peripheral surface.

* * * * *